US007739951B2

(12) United States Patent
Stäb

(10) Patent No.: US 7,739,951 B2
(45) Date of Patent: Jun. 22, 2010

(54) METHOD AND PRINTING MACHINE FOR PRODUCING A PRINTED PRODUCT WITH A NUMBER OF INSERTS

(75) Inventor: Rudolf Stäb, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 590 days.

(21) Appl. No.: 11/659,958

(22) PCT Filed: Aug. 1, 2005

(86) PCT No.: PCT/EP2005/053742

§ 371 (c)(1),
(2), (4) Date: Feb. 12, 2007

(87) PCT Pub. No.: WO2006/018375

PCT Pub. Date: Feb. 23, 2006

(65) Prior Publication Data

US 2007/0252319 A1 Nov. 1, 2007

(30) Foreign Application Priority Data

Aug. 13, 2004 (DE) ..... 10 2004 039 560
Dec. 4, 2004 (DE) ..... 10 2004 058 493

(51) Int. Cl.
*B41F 13/56* (2006.01)

(52) U.S. Cl. ..... 101/227; 270/21.1; 493/424

(58) Field of Classification Search ..... 101/226, 101/227; 493/424, 425, 426, 427, 428, 429; 270/4, 5.01, 8, 16, 20.1, 21.1, 42, 49, 50
See application file for complete search history.

(56) References Cited

U.S. PATENT DOCUMENTS

| | | | | |
|---|---|---|---|---|
| 3,948,504 | A | 4/1976 | Woessner et al. | |
| 4,026,537 | A | 5/1977 | Harris | |
| 4,159,823 | A | 7/1979 | Bryer et al. | |
| 4,391,596 | A * | 7/1983 | Fischer | 493/425 |
| 4,720,091 | A * | 1/1988 | Kobler | 270/52.01 |
| 4,754,959 | A * | 7/1988 | Kobler et al. | 270/21.1 |
| 5,520,378 | A * | 5/1996 | Kepert et al. | 270/8 |
| 5,551,678 | A | 9/1996 | Michalik et al. | |
| 6,435,092 | B1 | 8/2002 | Hillebrand | |

(Continued)

FOREIGN PATENT DOCUMENTS

| | | |
|---|---|---|
| EP | 0 114 352 | 8/1984 |

(Continued)

*Primary Examiner*—Ren Yan
(74) *Attorney, Agent, or Firm*—Jones, Tullar & Cooper, P.C.

(57) ABSTRACT

A printed product, with a number of inserts, is printed on a printing machine. The pages of the inserts are printed by the printing machine as product pages on the web. The web is then folded in a folder that is a part of the printing machine to thereby form at least one of the inserts of the printed product. The printed product is laid out at an exit of the folder and the web is folded in such a manner that a final format of each insert completely shows one of these printed pages. Before the printed product is laid out at the exit of the folder, inserts which belong to the same printed product are collected in the folder by placing these inserts one atop the other.

14 Claims, 3 Drawing Sheets

U.S. PATENT DOCUMENTS

| | | | |
|---|---|---|---|
| 6,945,923 | B2 | 9/2005 | Graber et al. |
| 2006/0162593 | A1 | 7/2006 | Bolza-Schunemann |

FOREIGN PATENT DOCUMENTS

| | | | |
|---|---|---|---|
| EP | 0 661 227 | A1 | 12/1994 |
| EP | 1 209 000 | A1 | 5/2002 |
| WO | WO 99/30909 | | 9/1999 |
| WO | WO 2004/067275 | | 8/2004 |

* cited by examiner

METHOD AND PRINTING MACHINE FOR PRODUCING A PRINTED PRODUCT WITH A NUMBER OF INSERTS

CROSS-REFERENCE TO RELATED APPLICATIONS

This patent application is the U.S. national phase, under 35 USC 371, of PCT/EP2005/053742, filed Aug. 1, 2005; published as WO 2006/018375 A2 and A3 on Feb. 23, 2006, and claiming priority to DE 10 2004 039 560.8, filed Aug. 13, 2004 and to DE 10 2004 058 493.1, filed Dec. 4, 2004, the disclosures of which are expressly incorporated herein by reference.

FIELD OF THE INVENTION

The present invention is directed to a method for producing a printed product having several inserts, and to a printing press, with at least one printing group and with at least one folding apparatus, for use in producing a printed product including several inserts. The pages of the inserts are printed in the printing press by imprinting printed pages on a web of material. The web is folded into at least one of the inserts in a folding apparatus which is part of the printing press. The printed product is deposited at an outlet of the folding apparatus. A final format of each insert completely depicts one of the printed pages.

BACKGROUND OF THE INVENTION

Printing presses, and in particular web-fed rotary presses, preferably having several printing groups, and further having at least one folding apparatus with at least one former, are typically used for newspaper printing. The printing presses can also have several sections, each one preferably with several printing groups. Webs of material, such as, for example, paper webs, which are imprinted in different sections, are united in the at least one folding apparatus to produce a common printed material.

The pages of the printed product can be printed in the at least one printing group of such a printing press in broadsheet production format or in tabloid production format. The printed product is subsequently delivered at an outlet of the folding apparatus which is a part of this printing press. In their final format, printed products, which have been produced in tabloid format, have a complete imprinted page, such as, for example, a page of text. The surface defined by the final format of the printed product is not folded. In contrast, the pages of a printed product formed in broadsheet format have a transverse fold extending parallel with regard to the format width, such as, for example, with regard to the imprinted lines of text, so that for a complete view of its imprinted pages the printed product printed in broadsheet format must be opened at this transverse fold. A fold is to be understood in this context to be a reshaping of the material, which fold forms a so-called fold break in the imprinted web of material.

Printing presses, which are employed for newspaper printing, form printed products, in this case newspapers in particular, in a production format that is fixed or determined by press elements, namely either in a broadsheet format or in a tabloid format. The tabloid format is smaller, with respect to the surface of the pages of the printed product, than is the broadsheet format. In regard to its surface, which is determined by its height and width, a newspaper that is printed in tabloid format is, for example, only half as large as a newspaper which is produced in broadsheet format. Printed products which are formed in tabloid format can be produced, for example, wherein the web of material, which is imprinted in at least one printing group of the printing press, is slit, preferably prior to its passage through a former of the printing press that is located downstream of the printing group in the production direction. This slitting of the web is accomplished on or at the former and extends along the web's transport direction, such as, for example by the use of a cutting arrangement. Partial webs, which are formed by the slitting of the web of material, are placed on top of each other. In the course of their further passage through the folding apparatus, the partial webs, which are lying on top of each other, are folded at least once transversely to their transport direction.

A portion of a printed product, which is combined by being bundled together, such as, for example by the provision of a transverse fold, is called an insert for this printed product. Different inserts of the printed product can relate to different segments of the printed product, wherein the individual segments can differ, for example, in their content. The individual segments can be, for example, assigned to one or to several of the parts customarily constituting a newspaper, such as politics, economy, sports, features or real estate, for example, or which differ from each other by the editorial portion and the advertising portion of a newspaper. The format of an insert is fixed by the width and by the height extending orthogonally, with regard to the latter, of its pages. The width is identified by a direction extending parallel with respect to a text imprinted on the page. In other words, the page's width is parallel to its lines of text. With printed products which are manufactured in tabloid format, one of the printed pages which is imprinted by the printing press is completely contained on the pages of its inserts, and the format of these inserts agrees with the final format of the printed product.

A need has now arisen to manufacture printed products with several inserts, and wherein the inserts, which are part of a defined printed product, are not combined by being placed inside each other. However, for printed products that are formed in tabloid format, such as, for example, as a newspaper, it is not possible at present, with the use of known folding apparatuses, to produce printed products with several inserts other than those with inserts placed therein. This is because all partial ones of the webs of a defined printed product are first assembled in the folding apparatus and are then together transversely folded. Until now, printed products in tabloid format, which consist of several inserts, are combined by the use of devices that are specially provided for this, such as, for example, in a shipping department which is located downstream of the printing press, but which is not located within the printing press.

SUMMARY OF THE INVENTION

The object of the present invention is directed to providing a method for producing a printed product with several inserts. The printed product is imprinted in a printing press and is delivered in tabloid form at an outlet of a folding apparatus which is part of the printing press, wherein the printing press, which is printing such printed products, produces such printed products ready for vending. A further object of the present invention is the provision of a printing press with at least one printing group and with at least one folding apparatus for manufacturing a printed product of several inserts, and wherein the printing press manufactures the printed product to be formed or produced ready for vending. In accordance with the object of the present invention, a further printing process, which has, in the past, typically been performed separately from the printing press, is integrated into the printing press. At the outlet of its folding deposit device, the printing press, in accordance with the present invention, makes available printed products in tabloid format, and consisting of several inserts.

In accordance with the present invention, the object is attained by the production of a printed product having several inserts. The pages of the inserts are printed on a web of material as printed pages. The web of material is folded into at least one of the inserts of the printed product in a folding apparatus which is a part of the printing press. The web of material is folded in such a way that a final format of each insert completely depicts one of the printed pages. Prior to the depositing of the printed product at the outlet of the folding apparatus, inserts, which are part of the same printed product, are assembled in the folding apparatus. The assembly of the inserts, which are part of the same printed product, is accomplished in such a way that an assembling device places the inserts, which are each provided as a printed product, on top of each other.

The advantages to be gained, by the present invention lie, in particular, in that these advantages make it possible to produce printed products containing several inserts "in line", or, in other words, in the running production process. Printed products in tabloid format consist of inserts which are configured to be either identical or different. Printed products of several inserts and formed within the printing press can be manufactured by using the high production speed of the printing press of, for example, 40,000 or more pieces per hour which, in contrast to performing of further printing operations separately from the printing press, means a considerable speed advantage and therefore also cost advantage. This is because, for example, devices which have been previously provided in the shipping department have not been able to produce, at least until now, printed products consisting of several inserts and at the production speed of a printing press.

A further advantage of the present invention is that the structure of printing presses, which are used in newspaper printing, can be simplified. If it is intended to produce a printed product consisting of several inserts, in which only the placement of several partial webs is required during production, but without performing a fold in a former, it is possible to omit the provision of one or of several formers in the printing press. The configuration of the superstructure of the printing press, which is typically arranged downstream of the printing groups, in the transport direction of the web of material, may be simplified. Because of this simplification, the printing press can be constructed more cost-effectively.

It is possible, for example by the use of the method in accordance with the present invention to produce newspapers of smaller format than is conventionally customary. This corresponds to an upcoming trend, because such newspapers of smaller format are easier to handle by a reader.

BRIEF DESCRIPTION OF THE DRAWINGS

Preferred embodiments of the present invention are represented in the drawings and will be described in greater detail in what follows. It will be understood that a printing press, by the use of which the printed product is actually printed, is not specifically represented. Only the folding apparatus, which is a part of the printing press is specifically represented.

Shown are in.

DESCRIPTION OF PREFERRED EMBODIMENTS

Conventionally, in the production of a printed product, such as a newspaper, a printing press with at least one folding apparatus is employed, which at least one folding apparatus performs a product formation by the formation of at least one web of material which is being imprinted in a printing group of the printing press, or by the formation of at least of one continuous web of this web of material, into individual inserts of the printed product to be manufactured. The at least one folding apparatus produces these individual inserts in a double production or in an assembling production process, and delivers the folded inserts. The printed product, which is ready for vending and which consists of several inserts that have been placed on top of each other, is only manufactured in a further process which is performed downstream of the printing press. Different sections of the printing press can produce inserts which are all part of the same printed product and which each have a different number of pages. If required, a continuous stapler, which can be employed for further processing, then staples and fixes these inserts with different numbers of pages. After the continuous stapling of the individual inserts which are part of the same printed product, they are assembled and the complete printed products are folded again, if required, such as, for example, are longitudinally folded and are delivered.

Different types of the embodiment of the present invention exist for the attainment of the object of producing a printed product consisting of several inserts in a printing press, in particular in a web-fed rotary printing press, and preferably in a printing press that is operating in accordance with an offset printing method, but not in a further processing device which is located downstream of the printing press. These embodiments have in common that, prior to the deposit of the ready-to-sell printed product at an outlet of a folding apparatus which is a part of the printing press, such as, for example, a jaw-type folding apparatus or a drum-type folding apparatus, inserts which are part of the same printed product are assembled in the folding apparatus. This is accomplished in accordance with the present invention by placing these inserts on top of each other by the use of an assembly device. The folding apparatus forms at least one web of material which is imprinted in the printing group, or forms at least one continuous web of this web of material, into individual folded products, by cutting and folding, or forms the web into individual inserts, each consisting of one or several folded products.

Figure 1:
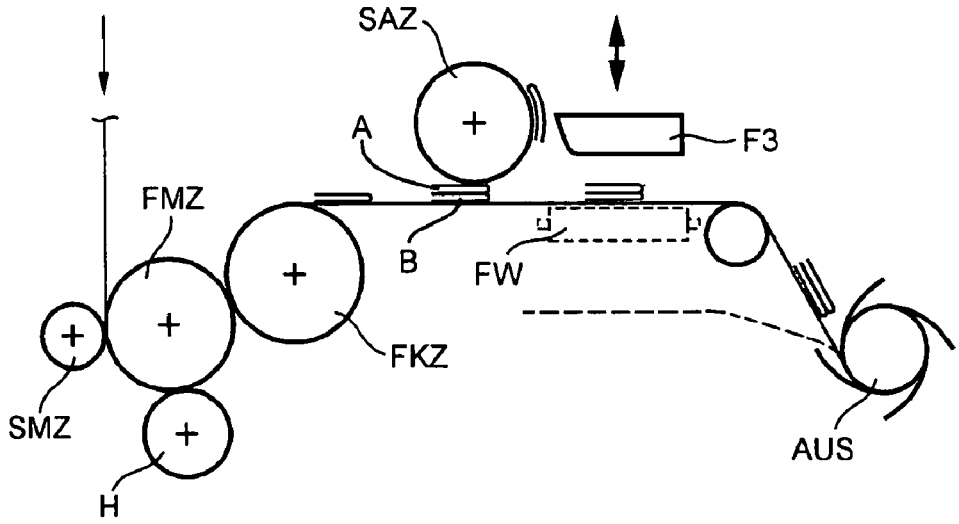
FIG. 1, a folding apparatus in accordance with the present invention and usable for manufacturing a printed product in tabloid format with several inserts, in FIG. 2, a double folding apparatus, in FIG. 3, a double folding apparatus with additional assembling cylinders, in FIG. 4, a folding apparatus provided with the option for processing several proof copies in the circumferential direction, in FIG. 5, a schematic depiction of a forme cylinder with printing formes for use in printing in broadsheet format, and in FIG. 6, a schematic depiction of a forme cylinder with printing formes for use in printing in tabloid format.

In a first embodiment of the present invention, FIG. 1 shows a folding apparatus for use in the production of a printed product which is in tabloid format and which contains several inserts. The entry into the folding apparatus of the web or webs of material, which have previously been imprinted in the printing press, is indicated, in each one of FIGS. 1 to 4, by the use of a directional arrow generally at the left of each such figure. Partial webs which are provided to the folding apparatus, preferably by at least one upstream located printing group of the printing press, can have been produced by the operation of a cutting device that is arranged, for example, upstream, in the web travel or production direction, of the folding apparatus. The cutting device may be, for example, a circular blade, and the partial webs can be provided in the form of a previously performed symmetrical, or asymmetrical, cut of the web of material. The partial webs, or also the continuous webs, which are obtained from the web of material, and which are provided to the folding apparatus, can be provided with a wave-shaped cut, or can also be provided with lateral punchings that have been provided by a punching device. Cutouts, which are provided in the web of material or in its partial webs by the wave-shaped cutting, or by the lateral punching, can form, for example, recesses for use in gripping the finished printed product to provide for easier opening of individual pages of the printed product.

The folding apparatus is operated in a double production mode. Downstream of a folding jaw cylinder FKZ which is arranged in the folding apparatus, the two folded products A and B, which have been formed by the folding apparatus, in this way are placed on top of each other on a conveying device, such as, for example, a conveyor belt, by an assembling cylinder SAZ and are assembled in this way. Subsequently, a deposit of the assembled folded products A and B at the outlet AUS of the folding apparatus takes place, for example in a fish-scale or shingled configuration, with identical or with varying spacing. The assembled folded products A and B are delivered, for example staggered in a fish scale-like or shingled manner, through the use of a paddle wheel, all as depicted schematically in FIG. 1. The assembled folded products A and B can optionally be combined into a product while still in the folding apparatus prior to their deposit at the outlet AUS of the folding apparatus, possibly by the provision of a third fold, such as, for example, a third fold which is provided longitudinally with respect to the conveying direction of the printed product. In this first embodiment depicted in FIG. 1, only inserts with the same number of pages are processed, which inserts can be stapled or not stapled. Stapling is performed, if desired, in a stapler H that is arranged in the folding apparatus, as seen in FIG. 1. The stapler H is arranged upstream of the folding jaw cylinder FKZ in the transport direction of the printed product at a folding blade cylinder FMZ, which folding blade cylinder FMZ works together with the folding jaw cylinder FKZ. A cutting blade cylinder SMZ, which is working together with the folding blade cylinder FMZ is only schematically depicted in each one of FIGS. 1 to 4. A printing press whose rotating printing bodies, for example forme cylinders, each have several printing formes on their circumference, such as, for example three such printing formes, can produce a printed product in this way, such as, for example, can produce a newspaper with several, such as, for example, with three inserts, wherein each one of these inserts consists of one of these folded products A and B, for example.

The third fold makes a further, such as, for example, makes a second longitudinal fold, in the printed product which is now consisting of several inserts. This longitudinal fold can be achieved by the use of a knife folding device F3. A folding knife or blade, which may also be called a sword, whose cutting edge is arranged linearly in regard to the transport direction of the inserts, and which preferably is vertically movable, pushes a copy of the horizontally conveyed printed product, consisting of several inserts A, B, between two folding rollers or folding cylinders FW, which are arranged side-by-side horizontally adjoining and with their respective axes also oriented longitudinally in the transport direction of the printed product, as depicted in dashed lines in FIG. 1. These two folding rollers or folding cylinders FW have opposite directions of rotation, with respect to each other. The directions of rotation of the two cooperating folding rollers or folding cylinders FW have been set in such a way that a printed product, consisting of several inserts, A, B, which printed product is pushed by the vertically movable knife F3 into the entry roller gap between the two folding rollers or folding cylinders FW, is formed by the direction of rotation of the two folding rollers or folding cylinders FW. Such a printed product, provided with a third fold, is conveyed between the two folding rollers or folding cylinders FW, which are shown by dashed lines, as indicated previously. The vertical movement of the knife F3 during the forming of the third fold is indicated in FIGS. 1 to 4 by respective two-headed arrows. After the printed product consisting of several inserts has passed the third fold forming device F3, it is then conveyed, for example by the use of a conveying device, for deposit at the outlet AUS of the folding apparatus.

The third fold, which is formed by the third fold folding device F3, has the purpose of uniting the several inserts of the printed product, consisting of several inserts, into a transportable unit for vending, so that the inserts of this printed product dependably remain together on their way to the vending point. The result is that no incomplete copies of this printed product are formed. In prior products, individual inserts, which were a part of a printed product, have become lost, for example because of incorrect sorting.

The employment of the third fold, formed by the third fold forming device F3, requires that a previous transverse fold, which was provided in the individual inserts, be broken. This can lead to problems in connection with printed products including several inserts, and in particular can cause problems when the respective individual inserts each have a large number of pages. As an alternative to the formation of such a third fold, it is therefore possible to provide that the inserts, which are part of a printed product, are combined by the provision of a tape around them, or by the provision of a pocket-shaped case, into which case the inserts, which are part of the printed product, are placed. It is also possible to apply a staple, which keeps several inserts of the printed product together. In a further alternative, it can be provided that the inserts, which are part of a printed product, are connected by material contact, such as, for example, by the use of an adhesive or a glue, with each other, so that a bond between inserts which are part of a printed product is assured until the printed products, with their respective inserts, arrive at the point of vending. A material connection which may be applied, for example, only at, or close to the edge of the bundle of inserts which are part of the printed product can be quite sufficient to bond the inserts.

Figure 2:
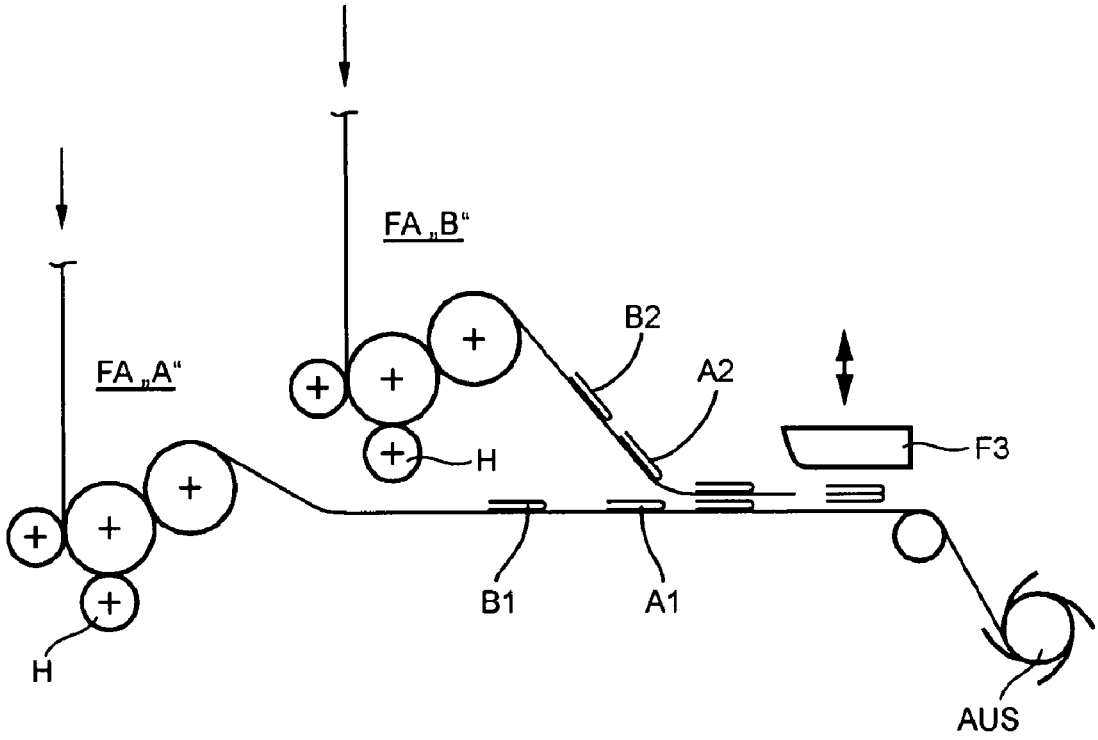

A printing press with a double folding apparatus is represented as second embodiment of the present invention in FIG. 2. In a first variation of this second embodiment, the two folding apparatuses FA"A" and FA"B" each produce their respective inserts, without assembly, and the individual inserts can either be stapled together or not stapled together. Stapling possibly takes place in staplers H which are assigned to each of the respective folding apparatuses FA"A" and FA"B". The folding apparatus FA"A", for example, produces folded products Al and B1, and the folding apparatus FA"B" produces folded products A2 and B2, for example. The folded products A1 and B1, as well as the folded products A2 and B2, are placed on top of each other with the aid of an assembly device, such as, for example, by bringing their respective transport tracks together. The assembled folded products A1, A2; B1, B2 are provided, for example, with a third fold by the third fold forming device, F3 in the previously described manner, or are each deposited as a tabloid product. In this second embodiment, the production of printed products with different insert structures, and in particular with different numbers of pages for each such insert, is possible. If, in a second variation of the second embodiment, the two folding apparatuses FA"A" and FA"B" each produce an insert with assembling, and wherein the individual inserts can either be stapled together or not stapled together, the assembled products A1, A2, as well as B1, B2, are placed on top of each other and receive a third fold through operation of the third fold forming device F3, for example, or are delivered as a tabloid product, as previously described in connection with FIG. 1. In this second variation of the second embodiment of the present invention, the manufacture of printed products with differing insert structures, or with different numbers of pages, is also possible.

Figure 3:
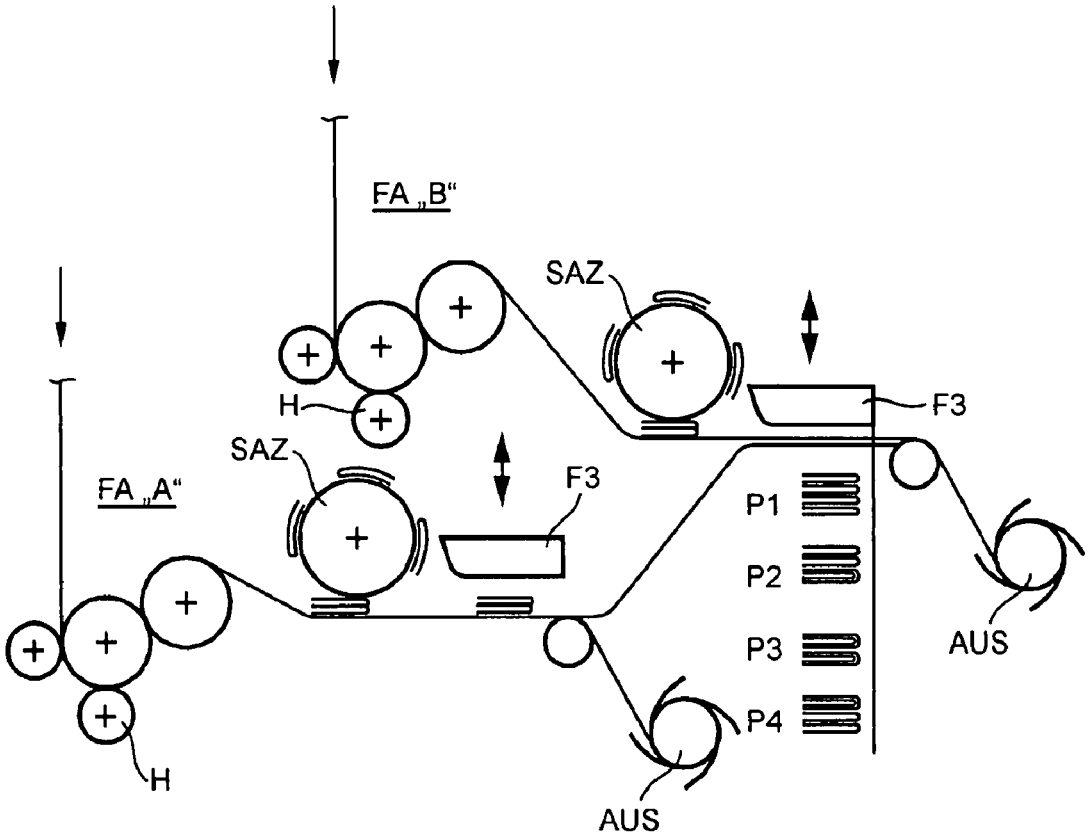

FIG. 3 shows a third preferred embodiment of a printing press in accordance with the present invention, and with a double folding apparatus, in which printed products with several inserts of several variations can be produced. In a first variation, the two folding apparatuses FA"A" and FA"B" each produce their respective inserts without assembly and the individual inserts can either be stapled together or not stapled together. For example, an additional assembling cylinder SAZ, similar to the assembling cylinder SAZ of FIG. 1, is provided for each of the two folding apparatuses FA"A" and FA"B" of the third embodiment shown in FIG. 3. The assembling cylinders SAZ place the inserts, which have been produced in their respective folding apparatus FA"A" and FA"B", on top of each other. After they have been provided with a third fold, by the use of the third fold forming device F3, for example, the inserts which were produced as tabloid products and which were placed on top of each other, are delivered, as was previously described in connection with FIG. 1. A product P1 with four inserts placed on top of each other is thus formed, wherein the insert structures of the inserts fed in from the folding apparatus FA"A" and FA"B" can be different.

In a second variation of the third embodiment of the present invention, the folding apparatus FA"A" produces inserts in an assembled manner, either stapled or unstapled, and the folding apparatus FA"B" produces inserts in an unassembled manner, either not stapled or partially stapled. The inserts which are folded in the folding apparatus FA"B" are placed on top of each other by the additional assembling cylinder SAZ and are subsequently placed onto the assembled product made available by the folding apparatus FA"A". The inserts placed on each other are provided, for example, with a third fold, through the use of the third fold forming device F3, or are delivered as a tabloid product, as previously explained in connection with FIG. 1. A product P2 with three inserts placed on top of each other is thus produced, wherein the insert structure of the inserts made available by the folding apparatus FA"B" is always identical. The assembled product made available by the folding apparatus FA"A" can have the same number of pages as the inserts made available by the folding apparatus FA"B", or can have another, and in particular can have a greater number of pages. The assembling cylinder SAZ in the folding apparatus FA"A" is not in operation for manufacturing the products P2.

In a third variation of the third preferred embodiment of the present invention, the folding apparatuses FA"A" and FA"B" produce in an assembled manner, stapled or not stapled. The folded and assembled products are not processed by the additional assembling cylinders SAZ. These folded, assembled products receive, for example, a third fold by operation of the third fold formed device F3, or are delivered as tabloid products, as previously described in connection with FIG. 1. The product P3 is formed, as depicted in FIG. 3, in which two assembled products are placed on top of each other, and wherein the insert structures of the assembled products made available by the folding apparatuses FA"A" and FA"B" can be different.

In a fourth variation of the third preferred embodiment depicted in FIG. 3, the folding apparatus FA"A" produces in an unassembled manner, either stapled, not stapled or partially stapled, and the folding apparatus FA"B" produces inserts on the folding blade cylinder FMZ, in an assembled manner, either stapled or not stapled. The folded inserts from the folding apparatus FA"A" are placed on top of each other by the additional assembling cylinder SAZ and are subsequently laid underneath the assembled product made available by the folding apparatus FA"B". The inserts, which are thus laid on top of each other, receive, for example, a third fold, as provided by the-third fold forming device F3, or are delivered as tabloid products, as previously described in connection with FIG. 1. The product P4, as depicted in FIG. 3, is formed with three inserts placed on top of each other. The insert structure of the inserts made available by the folding apparatus FA"A" is always identical. The assembled product made available by the folding apparatus FA"B" can have the same number of pages as the inserts from the folding apparatus FA"A", or can have another, and in particular a greater number of pages. The assembling cylinder SAZ in the folding apparatus FA"B" is not in operation during the manufacturing of the products P4.

If the folding apparatus FA"A" has its own outlet AUS downstream of the third fold forming device F3, in the form of a separate transverse fold deposit device, as seen in FIG. 3, all of the production types of the previously described first embodiment of the present invention are also available as a fifth variation of the third preferred embodiment of the subject invention.

Figure 4:
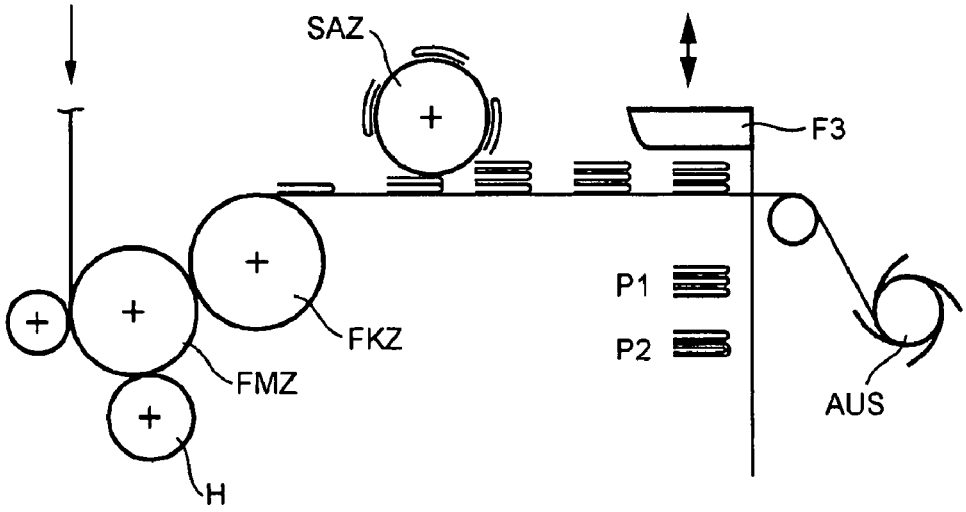

In a fourth embodiment of the present invention, as depicted in FIG. 4, production starts from a printing press whose rotary printing bodies, such as, for example, forme cylinders, have several printing formes, for example three printing formes, on their circumference. The folding apparatus assigned to this printing press is intended to have the following three production options. A multiple production, such as, for example, a triple production, wherein each printed product is a separate folded product P1; an assembly production, wherein the several, such as, for example, all three of the folded products, are assembled on the folding blade cylinder FMZ as a common insert; and a partial assembly production, in which a first partial batch of the folded products is folded, and another, second amount is assembled on the folding blade cylinder FMZ and are then folded off. This is depicted as product P2 in FIG. 4, wherein both partial batches complement each other to constitute the whole production. In the case of a total of three folded products, one folded product is folded and two folded products are assembled and are then folded off. The folding apparatus can have, for example, a folding blade cylinder FMZ divided into five sections, a folding jaw cylinder FKZ, which is also divided into six sections, and an assembling cylinder SAZ which is divided into four sections.

If the folding apparatus operates, for example, in triple production mode, the folded products A, B and C, which are following each other, are placed on top of each other downstream of the folding jaw cylinder FKZ and are assembled in this way on the assembling cylinder SAZ. Subsequently, the deposit of the assembled inserts takes place, or they are united into one product, such as, for example, by use of the third fold forming device F3. The product P1, as depicted in FIG. 4 is thus formed, and in which only inserts with the same number of pages are possible, which inserts can either be stapled or not stapled.

However, if the folding apparatus works in a partial assembly mode, the folded products A and B are for example assembled on the folding blade cylinder FMZ and are folded off to the folding jaw cylinder FKZ, while the product C is folded of the folding blade cylinder FMZ without being assembled. Thereafter, these different inserts are placed on top of each other downstream of the folding jaw cylinder FKZ and are assembled on the assembling cylinder SAZ. Their deposit takes place subsequently, or they are combined into one product, for example by use of the third fold forming device F3. The product P2, as depicted in FIG. 4 is thus formed. Either the assembled or the unassembled product can be stapled by the use of a three-piece stapler H.

If needed, the previously described four embodiments of the present invention can be expanded in that one or several further folding operations of the printed product are provided, such as, for example by the provision of a third longitudinal fold which is formed parallel with a longitudinal side of the printed product.

It is common to all of the above-described embodiments of the present invention that inserts, which are part of the same printed product, are assembled in the folding apparatus, not only partial webs which are part of the same printed product, before the printed product, consisting of several inserts, is deposited in the depository at the outlet AUS of the folding apparatus, which is a part of the printing press which prints the product to be printed. The inserts, which are combined into the same printed product, have previously received their first transverse fold before their combination for the purpose of their creation in the folding apparatus. As an optional embodiment, the third fold, which is provided by the third fold forming device, F3 acts on inserts which have already been combined into the same printed product.

Figure 5:
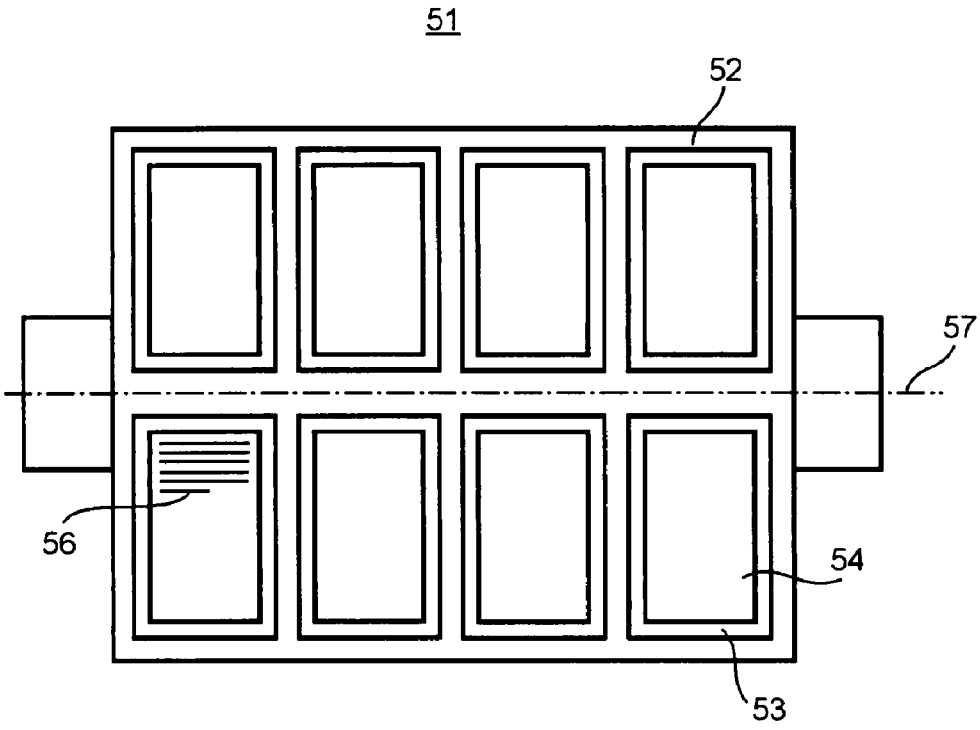
Figure 6:
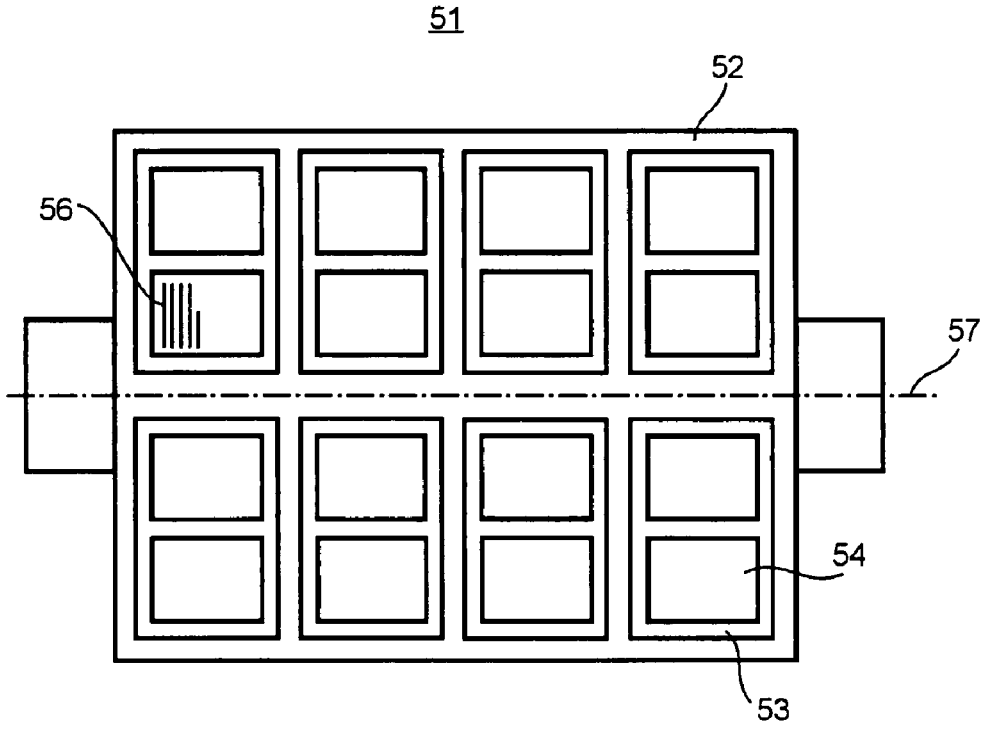

FIGS. 5 and 6 clarify the broadsheet or the tabloid production formats discussed above. FIG. 5 schematically shows a forme cylinder 51, on whose shell face 52, which is represented in an unwound or unflattened projection, several, such as, for example, eight, printing formes 53 are arranged, namely with four printing formes 53 spaced adjacent each other in the axial direction 57 of the forme cylinder 51, and with two printing formes 53 spaced in the circumferential direction of the forme cylinder 51. Print images 54, which are applied to each of the printing formes 53 reproduce, for example with the aid of a transfer cylinder, which is not specifically represented and which works together with the forme cylinder 51, on a respective printed page on a web of material to be imprinted, which web of material passes through the printing press. In connection with printed products in a broadsheet format, such as represented in FIG. 5, the printing formes 53, together with their print images 54, are arranged perpendicularly on the shell face 52 of the forme cylinder 51. Lines 56 of text of the print images 54 are oriented substantially parallel with respect to the axial direction 57 of the forme cylinder 51.

FIG. 6 shows a forme cylinder 51, also covered with several, such as, for example, with eight printing formes 53 on its shell face 52. Each one of these printing formes 53 respectively has two print images 54, for example. These two print images 54 on each such printing forme 53 are respectively arranged horizontally. Lines 56 of text of the print images 54 are oriented parallel in respect to the circumferential direction of the forme cylinder 51 and perpendicular to the cylinder's axis of rotation. Such a forme cylinder 51 produces printed pages imprinted on a web of material in tabloid format.

A comparison between FIGS. 5 and 6 shows that two forme cylinders 51 covered with printing formes 53 of respectively the same size create printed pages of different size in different numbers, depending on their production format; i.e. either broadsheet format or tabloid format. The format of printed pages printed in a tabloid format is smaller than that of pages printed in broadsheet format. However, in comparison with the broadsheet format, a larger amount of printed pages is produced with every revolution of the forme cylinder 51 in tabloid format. If the printed pages, which are printed in tabloid format, should correspond in size to printed products printed in the broadsheet format, the forme cylinder 51 and/or the printing forms 53 arranged on it must be differently dimensioned. A further difference resulting from different production formats is that the production speed of a forme cylinder 51, which is printing in broadsheet format, must be increased if the same number of printed pages is to be produced by it as in the tabloid production format.

Each one of the above-mentioned production formats also leads to different further processing of the imprinted web of material into a ready-to-vend printed product. Different folding patterns result in particular. For inserts whose final format is the tabloid format, the web of material is preferably folded in the folding apparatus, or is folded in connection with the folding apparatus in such a way that the final format of each insert completely depicts one of the printed pages previously imprinted on the web of material in a printing group of the printing press, wherein the various parts of the insert, i.e. the connection of its pages, is preferably arranged along the height of this insert. Accordingly, the formats of the insert and of the printed page therefore preferably correspond at least approximately to each other. Subsequently, a printed product in tabloid format is put together from several of these inserts in that, prior to the deposit of this printed product at the outlet of the folding apparatus, inserts which are part of the same copy of this printed product are assembled in the folding apparatus by placing these associated inserts, produced in tabloid format, on top of each other in the folding apparatus.

While preferred embodiments of a method and a printing machine for producing a printed product with a number of inserts, in accordance with the present invention, have been set forth fully and completely hereinabove, it will be apparent to one of skill in the art that various changes in, for example the specific structure of the printing units used to print the webs, the types of transports for the folded products, and the like could be made without departing from the true spirit and scope of the present invention which is accordingly to be limited only by the appended claims.

What is claimed is:

1. A printing press comprising:

at least one printing group, said at least one printing group adapted to print at least one web of material;

at least one folding apparatus having a folding apparatus outlet;

a cutting blade cylinder in said at least one folding apparatus;

a folding blade cylinder in said at least one folding apparatus and cooperating with said cutting blade cylinder to cut said at least one printed web of material into products;

a folding jaw cylinder in said at least one folding apparatus and in cooperation with said folding blade cylinder and adapted to produce a transverse fold in said products to form folded product inserts from said at least one printed web of material, said folded product inserts traveling in said at least one folding apparatus in a direction of travel of said web and being placed into a depository at an outlet of said at least one folding apparatus;

at least one assembly device in said at least one folding apparatus and adapted to assemble several of said folded product inserts formed in said at least one folding apparatus, said assembly device being located after said folding jaw cylinder in said folding apparatus and being usable to place said several folded product inserts on top of each other to form assembled folded products prior to deposit of said assembled folded products at said folding apparatus outlet;

a longitudinal fold forming device located in said at least one folding apparatus after, in said direction of web travel, said at least one assembly device and before, in said direction of web travel, said folding apparatus outlet, said longitudinal fold forming device being adapted to form a longitudinal fold in said assembled folded products before said folding apparatus outlet and to provide a complete printed product having a plurality of said ones of said printed product inserts; and an assembled folded product receiving paddlewheel located at said folding apparatus output and after said longitudinal fold forming device, said paddlewheel being adapted to receive said assembled complete printed products having said longitudinal fold and to deposit said transversely folded, assembled folded products, after having then been longitudinally folded to provided said complete printed products, in a fish-scale staggered form at said depository at said outlet of said at least one folding apparatus.

2. The printing press of claim 1 wherein said assembly device is an assembly cylinder.

3. The printing press of claim 2 further including said folding blade cylinder having first fields, said folding jaw cylinder having second fields and said assembly cylinder having third fields, said first, second and third fields being different in number from each other.

4. The printing press of claim 1 further including a stapler located before, in said direction of web travel, said folding jaw cylinder.

5. The printing press of claim 1 further including a stapler adapted to work with said folding blade cylinder.

6. The printing press of claim 1 wherein said longitudinal fold forming device is a blade folder.

7. The printing press of claim 1 further including first and second transverse folding apparatuses.

8. The printing press of claim 7 wherein at least one of said first and second transverse folding apparatuses includes said at least one assembly device.

9. The printing press of claim 7 wherein each of said first and second transverse folding apparatuses includes one of said assembly devices.

10. The printing press of claim 7 wherein each of said first and second transverse folding apparatuses includes at least one of said assembly devices, each said assembly device in each said folding apparatus having a combination of transport tracks different from a combination of transport tracks in the other of said folding apparatuses.

11. The printing press of claim 7 wherein at least one of said first and second transverse folding apparatuses includes said longitudinal fold forming device.

12. The printing press of claim 11 wherein said outlet of at least one of said first and second folding apparatuses is a transverse fold deposit device.

13. The printing press of claim 12 wherein said transverse fold deposit device is after said longitudinal fold forming device.

14. The printing press of claim 1 further including a longitudinal cutting device located before, in said direction of web travel, said at least one transverse folding apparatus, said longitudinal cutting device being adapted to cut said at least one web of material into partial webs longitudinally.

* * * * *